US012392017B2

(12) United States Patent
Toda et al.

(10) Patent No.: US 12,392,017 B2
(45) Date of Patent: Aug. 19, 2025

(54) HOT-STAMPING FORMED BODY

(71) Applicant: NIPPON STEEL CORPORATION, Tokyo (JP)

(72) Inventors: Yuri Toda, Tokyo (JP); Shinichiro Tabata, Tokyo (JP); Kodai Murasawa, Tokyo (JP); Daisuke Maeda, Tokyo (JP); Kazuo Hikida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 641 days.

(21) Appl. No.: 17/781,231

(22) PCT Filed: Jan. 8, 2021

(86) PCT No.: PCT/JP2021/000432
§ 371 (c)(1),
(2) Date: May 31, 2022

(87) PCT Pub. No.: WO2021/141103
PCT Pub. Date: Jul. 15, 2021

(65) Prior Publication Data

US 2023/0002874 A1 Jan. 5, 2023

(30) Foreign Application Priority Data

Jan. 9, 2020 (JP) ..... 2020-002407

(51) Int. Cl.

| | |
|---|---|
| ***C22C 38/38*** | (2006.01) |
| ***C22C 38/00*** | (2006.01) |
| ***C22C 38/02*** | (2006.01) |
| ***C22C 38/06*** | (2006.01) |
| ***C22C 38/08*** | (2006.01) |
| ***C22C 38/10*** | (2006.01) |
| ***C22C 38/16*** | (2006.01) |
| ***C22C 38/22*** | (2006.01) |
| ***C22C 38/26*** | (2006.01) |
| ***C22C 38/28*** | (2006.01) |
| ***C22C 38/32*** | (2006.01) |

(52) U.S. Cl.
CPC ..... *C22C 38/38* (2013.01); *C22C 38/001* (2013.01); *C22C 38/002* (2013.01); *C22C 38/005* (2013.01); *C22C 38/02* (2013.01); *C22C 38/06* (2013.01); *C22C 38/08* (2013.01); *C22C 38/10* (2013.01); *C22C 38/16* (2013.01); *C22C 38/22* (2013.01); *C22C 38/26* (2013.01); *C22C 38/28* (2013.01); *C22C 38/32* (2013.01)

(58) Field of Classification Search
CPC ..... C21D 2211/001; C21D 2211/002; C21D 2211/008; C21D 2201/05
See application file for complete search history.

(56) References Cited

U.S. PATENT DOCUMENTS

| | | | | |
|---|---|---|---|---|
| 2018/0298462 | A1 | 10/2018 | Sano et al. | |
| 2019/0309385 | A1 * | 10/2019 | Yi | C22C 38/46 |
| 2020/0157666 | A1 | 5/2020 | Sakakibara et al. | |
| 2021/0130919 | A1 | 5/2021 | Takashima et al. | |

FOREIGN PATENT DOCUMENTS

| | | | | |
|---|---|---|---|---|
| EP | 2 581 465 | A1 | 4/2013 | |
| JP | 2006-152427 | A | 6/2006 | |
| JP | 2010-174298 | A | 8/2010 | |
| JP | 2017-53001 | A | 3/2017 | |
| WO | WO 2016/199922 | A1 | 12/2016 | |
| WO | WO 2018/033960 | A1 | 2/2018 | |
| WO | WO-2019093384 | A1 * | 5/2019 | B32B 15/012 |

* cited by examiner

*Primary Examiner* — Anthony M Liang
(74) *Attorney, Agent, or Firm* — Birch, Stewart, Kolasch & Birch, LLP

(57) ABSTRACT

A hot-stamping formed body has a predetermined chemical composition and includes microstructure which includes residual austenite of which an area ratio is 5% or more and less than 10%. Among grain boundaries of crystal grains of bainite and tempered martensite in the microstructure, a ratio of a length of a grain boundary having a rotation angle in a range of 55° to 75° to a total length of a grain boundary having a rotation angle in a range of 4° to 12°, a grain boundary having a rotation angle in a range of 49° to 54°, and a grain boundary having a rotation angle in a range of 55° to 75° to the <011> direction as a rotation axis is 30% or more. The tensile strength of the hot-stamping formed body is 1500 MPa or more.

3 Claims, 1 Drawing Sheet

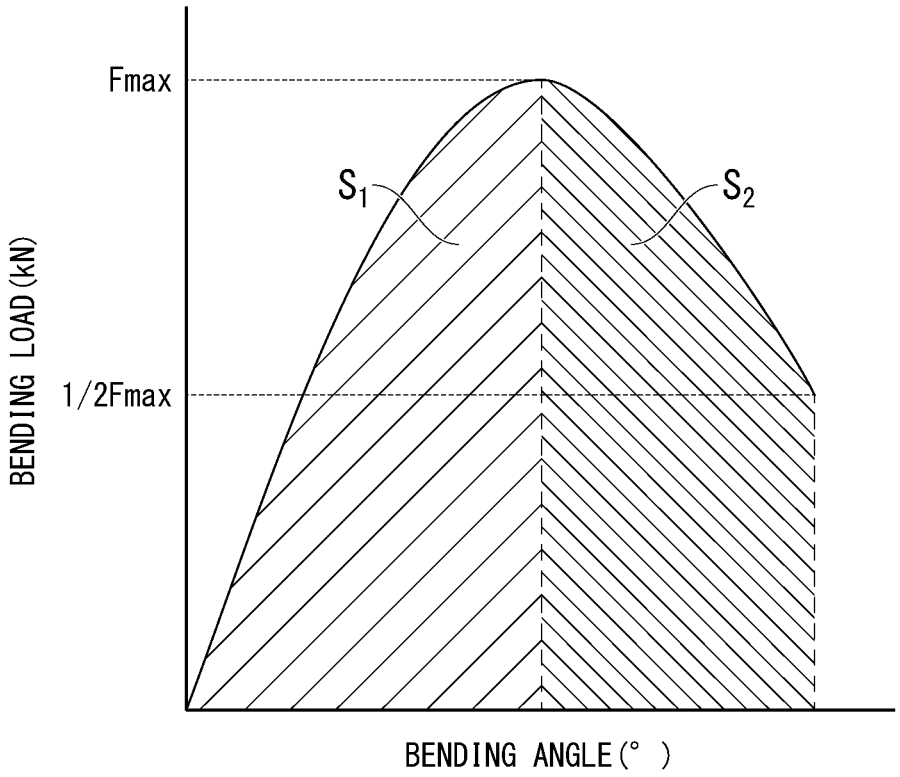
Fmax
1/2Fmax
BENDING LOAD (kN)
S1
S2
BENDING ANGLE (° )

HOT-STAMPING FORMED BODY

TECHNICAL FIELD OF THE INVENTION

The present invention relates to a hot-stamping formed body.

Priority is claimed on Japanese Patent Application No. 2020-002407, filed Jan. 9, 2020, the content of which is incorporated herein by reference.

RELATED ART

In recent years, there has been a demand for a reduction in the weight of the vehicle body of a vehicle in terms of environmental, protection and resource saving, and a high-strength steel sheet has been applied to vehicle members. Vehicle members are manufactured by press forming, but not only a forming load is increased but also the formability deteriorates as the strength of a steel sheet is increased. For this reason, the formability of a high-strength steel sheet into a member having a complicated shape becomes an issue. In order to solve this issue, the application of hot stamping technology in which press forming is performed after a steel sheet is heated up to a high temperature of an austenite range where the steel sheet softens is in progress. Hot stamping is attracting attention as technology that achieves both the formability of a steel sheet into a vehicle member and the strength of a vehicle member by performing the hardening of the steel sheet in a die at the same time as press working.

In order to obtain a higher effect of reducing the weight of a vehicle body from a vehicle member into which a steel sheet is formed by hot stamping, it is necessary to obtain a member that has high strength and is also excellent in collision characteristics.

Patent Document 1 discloses a hot-dip galvanized steel sheet and a hot-dip galvannealed steel sheet that are stabilized by the concentration of C and Mn and are improved in strength, uniform deformability, and local deformability by containing 10% by volume or more of residual austenite, and methods of manufacturing the hot-dip galvanized steel sheet and the hot-dip galvannealed steel sheet.

Patent Document 2 discloses a hot-dip galvannealed steel sheet that is improved in strength, uniform deformability, and local deformability by including residual austenite of 10% by volume or more and including high-temperature tempered martensite and low-temperature tempered martensite at predetermined volume percentages.

Patent Document 3 discloses a high-strength hot press-formed member that is improved in ductility and bendability by including composite structure as the structure of steel and controlling a ratio of each structure of the composite structure.

A vehicle member that has excellent strength and is more excellent in collision characteristics than the related art is desired in terms of safety.

PRIOR ART DOCUMENT

Patent Document

[Patent Document 1] Japanese Unexamined Patent Application, First Publication No. 2017-53001

[Patent Document 2] PCT International Publication No. WO2016/199922

[Patent Document 3] PCT International Publication No. WO2018/033960

DISCLOSURE OF THE INVENTION

Problems to be Solved by the Invention

An object of the present invention is to provide a hot-stamping formed body that is excellent in strength and collision characteristics.

Means for Solving the Problem

The gist of the present invention is as follows.

[1] A hot-stamping formed body according to an aspect of the present invention includes, as a chemical composition, by mass %:

C: 0.30% to 0.50%;
Si: 0.50% to 3.00%;
Mn: 0.50% to 3.00%;
Al: 0.0002% to 2.000%;
P: 0.100% or less;
S: 0.1000% or less;
N: 0.0100% or less;
Nb: 0% to 0.150%;
Ti: 0% to 0.150%;
Co: 0% to 2.00%;
Mo: 0% to 1.00%;
Cr: 0% to 1.00%;
Cu: 0% to 1.00%;
V: 0% to 1.00%;
W: 0% to 1.00%;
Ni: 0% to 3.00%;
Mg: 0% to 1.00%;
Zr: 0% to 1.00%;
Sb: 0% to 1.00%;
Ca: 0% to 0.10%;
REM: 0% to 0.30%;
B: 0% to 0.0100%; and
a remainder consisting of Fe and impurities; and microstructure which includes residual austenite of which an area ratio is 5% or more and less than 10%, bainite and tempered martensite of which a total area ratio exceeds 90% and is 95% or less, and a remainder in microstructure of which an area ratio is less than 5%, among grain boundaries of crystal grains of the bainite and the tempered martensite, a ratio of a length of a grain boundary having a rotation angle in a range of 55° to 75° to a total length of a grain boundary having a rotation angle in a range of 4° to 12°, a grain boundary having a rotation angle in a range of 49° to 54°, and a grain boundary having a rotation angle in a range of 55° to 75° to the <011> direction as a rotation axis is 30% or more. A tensile strength of the hot-stamping formed body is 1500 MPa or more.

[2] The hot-stamping formed body according to [1] may further include, as the chemical composition, by mass %, one or two or more selected from the group consisting, of:

Nb: 0.010% to 0.150%;
Ti: 0.010% to 0.150%;
Co: 0.01% to 2.00%;
Mo: 0.005% to 1.00%;
Cr: 0.005% to 1.00%;
Cu: 0.001% to 1.00%;
V: 0.0005% to 1.00%;
W: 0.001% to 1.00%;
Ni: 0.001% to 3.00%;
Mg: 0.001% to 1.00%;
Zr: 0.001% to 1.00%;
Sb: 0.001% to 1.00%;
Ca: 0.001% to 0.10%;
REM: 0.001% to 0.30%; and
B: 0.0005% to 0.0100%.

Effects of the Invention

According to the aspect of the present invention, it is possible to obtain a hot-stamping formed body that is excellent in strength and collision characteristics.

BRIEF DESCRIPTION OF THE DRAWINGS

FIG. 1 is a diagram showing an, example of an F-S curve that is obtained from a bending test.

EMBODIMENTS OF THE INVENTION

The inventors have found that a hot-stamping formed body can be improved in collision characteristics while having high strength in a case where the microstructure of the hot-stamping formed body includes predetermined amounts of residual austenite and bainite and tempered martensite and a ratio of a length of a grain boundary (high angle boundary) having a rotation angle in a range of 55° to 75° to a total length of a grain boundary having a rotation angle in a range of 4° to 12°, a grain boundary having a rotation angle in a range of 49° to 54°, and a grain boundary (hereinafter, referred to as a high angle boundary) having a rotation angle in a range of 55° to 75° among grain boundaries of crystal grains of the bainite and the tempered martensite to the <011> direction as a rotation axis is set to 30% or more.

In this embodiment, excellent collision characteristics mean excellent uniform deformability and excellent crack propagation suppression characteristics.

A high angle boundary is a grain boundary that has the highest angle among grain boundaries included in the crystal grains of bainite and tempered martensite. When austenite is transformed into bainite or martensite, strain associated with the transformation is generated. In a case where austenite before transformation has high hardness or a case where prior austenite grains cannot be deformed, a high angle boundary, which is highly effective in relieving strain, is likely to be formed. The inventors have found that by applying pressure in a predetermined temperature range after hot stamping to make austenite in the state of undeformable, many high angle boundaries can be formed in a case where austenite is transformed into bainite or martensite.

A hot-stamping formed body according to this embodiment will be described in detail below. First, the reason why the chemical composition of the hot-stamping formed body according to this embodiment is to be limited will be described.

A limited numerical range described using "to" to be described below includes a lower limit and an upper limit. Numerical values represented using "less than" or "exceed" are not included in a numerical range. All percentages (%) related to the chemical composition mean mass %.

The hot-stamping formed body according to this embodiment includes, as a chemical composition, by mass %, 0.30% to 0.50% of C, 0.50% to 3.00% of Si, 0.50% to 3.00% of Mn, 0.0002% to 2.000% of Al, 0.100% or less of P, 0.1000% or less of S, 0.0100% or less of N, and a remainder consisting of Fe and impurities. Each element will be described in detail below "C: 0.30% to 0.50%"

C is an element that improves the strength of the hot-stamping formed body. Further, C is also an element that stabilizes residual austenite. In a case where the C content is less than 0.30%, the desired strength of the hot-stamping formed body cannot be obtained. For this reason, the C content is set to 0.30% or more. The C content is preferably 0.32% or more or 0.35% or more. On the other hand, in a case where the C content exceeds 0.50%, excellent uniform deformability is not obtained. For this reason, the C content is set to 0.50% or less. Preferably, the C content is 0.46% or less, 0.43% or less, or 0.40% or less.

"Si: 0.50% to 3.00%"

Si is an element that stabilizes residual austenite. In a case where the Si content is less than 0.50%, the above-mentioned effects are not obtained and the stabilization of residual austenite is insufficient. As a result, a desired amount of residual austenite cannot be obtained. For this reason, the Si content is set to 0.50% or more. The Si content is preferably 1.00% or more or 1.10% or more. On the other hand, in a case where the Si content exceeds 3.00%, the amount of ferrite is increased. As a result, a desired microstructure is not obtained. For this reason, the Si content is set to 3.00% or less. The Si content is preferably 2.70% or less, 2.30% or less, or 2.00% or less.

"Mn: 0.50% to 3.00%"

Mn is an element that is segregated at a prior austenite grain boundary and suppresses the formation of ferrite and pearlite. In a case where the Mn content is less than 0.50%, a large amount of ferrite and pearlite is generated. As a result, a desired microstructure cannot be obtained. For this reason, the Mn content is set to 0.50% or more. The Mn content is preferably 0.70% or more or 1.00% or more. On the other hand, in a case where the Mn content exceeds 3.00%, excellent uniform deformability is not obtained. For this reason, the Mn content is set to 3.00% or less. Preferably, the Mn content is 2.50% or less or 2.00% or less.

"Al: 0.0002% to 2.000%"

Al is an element that improves deformability by deoxidizing molten steel to suppress the formation of oxide serving, as the origin of fracture and improves the collision characteristics of the hot-stamping formed body. In a case where the Al content is less than 0.0002%, deoxidation is not sufficiently performed and coarse oxide is generated. As a result, the above-mentioned effects are not obtained. For this reason, the Al content is set to 0.0002% or more. The Al content is preferably 0.001% or more, 0.050% or more, 0.100% or more, or 0.300% or more. On the other hand, in a case where the Al content exceeds 2.000%, coarse oxide is generated in steel. As a result, the collision characteristics of the hot-stamping formed body deteriorate. For this reason, the Al content is set to 2.000% or less. The Al content is preferably 1.700% or less, 1.500% or less, 1.000% or less, or 0.800% or less.

"P: 0.100% or less"

P is an impurity element and serves as the origin of fracture by being segregated at a grain boundary. For this reason, the P content is set to 0.100% or less. The P content is preferably 0.050% or less or 0.030% or less. The lower limit of the P content is not particularly limited. However, in a case where the lower limit of the P content is reduced to be less than 0.0001%, cost required to remove P is significantly increased, which is not preferable economically. For this reason, 0.0001% may be set as the lower limit of the P content in actual operation.

"S: 0.1000% or less"

S is an impurity element and forms an inclusion in steel. Since this inclusion serves as the origin of fracture, the S content is set to 0.1000% or less. The S content is preferably 0.0500% or less, 0.0300% or less, or 0.0100% or less. The lower limit of the S content is not particularly limited. However, in a case there the lower limit of the S content is reduced to be less than 0.0001%, cost required to remove S is significantly increased, which is not preferable economically. For this reason, 0.0001% may be set as the lower limit of the S content in actual operation.

"N: 0.0100% or less"

N is an impurity element and, forms nitride in steel. Since this nitride serves as the origin of fracture, the N content is set to 0.0100% or less. The N content is preferably 0.0050% or less. The lower limit of the N content is not particularly limited. However, in a case where the lower limit of the N content is reduced to be less than 0.0001%, cost required to remove N is significantly increased, which is not preferable economically. For this reason, 0.0001% may be set as the lower limit of the N content in actual operation.

The remainder of the chemical composition of the hot-stamping formed body according to this embodiment may be Fe and impurities. Elements, which are unavoidably mixed from a steel raw material or scrap and/or during the manufacture of steel and are allowed in a range where the characteristics of the hot-stamping formed body according to this embodiment do not deteriorate, are exemplified as the impurities.

The hot-stamping formed body according to this embodiment may contain the following elements as arbitrary elements instead of a part of Fe. The contents of the following arbitrary elements, which are obtained in a case where the following arbitrary elements are not contained, are 0%.

"Nb: 0% to 0.150%"

"Ti: 0% to 0.150%"

Nb and Ti increase the ratio of a high angle boundary by refining prior austenite grains in heating before hot stamping and, suppressing the deformation of prior austenite in a case where austenite is transformed into bainite or martensite. In order to reliably exert this effect, it is preferable that the content, of even any one of Nb and Ti is set to 0.010% or more. On the other hand, since this effect is saturated even though the content of even any one of Nb and Ti exceeds 0.150%, it is preferable that each of the Nb content and the Ti content is set to 0.150% or less.

"Co: 0% to 2.00%"

"Mo: 0% to 1.00%"

"Cr: 0% to 1.00%"

"Cu: 0% to 1.00%"

"V: 0% to 1.00%"

"W: 0% to 1.00%"

"Ni: 0% to 3.00%"

Co, Mo, Cr, Cu, V, W, and Ni have a function to increase the strength of the hot-stamping formed body by being dissolved in prior austenite grains in the heating before hot stamping. Accordingly, it is possible to increase the ratio of a high angle boundary by suppressing the deformation of the prior austenite grains in a case where austenite is transformed into bainite or martensite. In order to reliably obtain this effect, it is preferable that any one or more of 0.01% or more of Co, 0.005% or more of Mo, 0.005% or more of Cr, 0.001% or more of Cu, 0.0005% or more of V, 0.001% or more of W, and 0.001% or more of Ni are contained. On the other hand, since the effect is saturated even though a large amount of these elements is contained, it is preferable that the Co content is set to 2.00% or less, each of the Mo content, the Cr content, the Cu content, the V content, and the W content is set to 1.00% or less, and the Ni content is set to 3.00% or less.

"Mg: 0% to 1.00%"

"Zr: 0% to 1.00%"

"Sb: 0% to 1.00%"

"Ca: 0% to 0.10%"

"REM: 0% to 0.30%"

Mg, Zr, Sb, Ca, and REM are elements that improve deformability by suppressing the formation of oxide serving as the might of fracture and improve the collision characteristics of the hot-stamping formed body. In order to reliably obtain this effect, it is preferable that the content of even any one of Mg, Zr, Sb, Ca, and REM is set to 0.001% or more. On the other hand, since the effect is saturated even though a large amount of these elements is contained, it is preferable that each of the Mg content, the Zr content, and the Sb content is set to 1.00% or less, the Ca content is set to 0.10% or less, and the REM content is set to 0.30% or less.

In this embodiment, REM refers to a total of 17 elements that are composed of Sc, Y, and lanthanoid and the REM content refers to the total content of these elements.

"B: 0% to 0.0100%"

B is an element that is segregated at a prior austenite grain boundary and suppresses the formation of ferrite and pearlite. In order to reliably exert this effect, it is preferable that the B content is set to 0.0005% or more. On the other hand, since the effect is saturated even though the B content exceeds 0.0100%, it is preferable that the B content is set to 0.0100% or less.

The chemical composition of the above-mentioned hot-stamping formed body may be measured by a general analysis method. For example, the chemical composition of the above-mentioned hot-stamping formed body may be measured using inductively coupled plasma-atomic emission spectrometry (ICP-AES). C and S may be measured using a combustion-infrared absorption method and N may be measured using an inert gas fusion-thermal conductivity method. In a case, where a plating layer is provided on the surface of the hot-stamping formed body, the chemical composition may be analyzed after the plating layer is removed by mechanical grinding.

Next, the microstructure of the hot-stamping formed body according to this embodiment will be described.

The hot-stamping formed body according to this embodiment includes residual austenite of which, the area ratio is 5% or more and less than 10%, bainite and tempered martensite of which the total area ratio exceeds 90% and is 95% or less, and a remainder in microstructure of which the area ratio is less than 5%. The hot-stamping formed body includes microstructure in which a ratio of the length of a grain boundary having a rotation angle in the range of 55° to 75° to the total length of a grain boundary having a rotation angle in the range of 4° to 12°, a grain boundary having a rotation angle in the range of 49° to 54°, and a grain boundary (high angle boundary) having a rotation angle in the range of 55° to 75° among grain boundaries of crystal grains of bainite and tempered martensite to the <011> direction as a rotation axis is 30% or more.

In this embodiment, microstructure at a depth position corresponding to ¼ of a sheet thickness from the surface of the hot-stamping formed body (a region between a depth corresponding to ⅛ of the sheet thickness from the surface and a depth corresponding to ⅜ of the sheet thickness from the surface) is specified. This depth position is an intermediate point between the surface of the hot-stamping formed body and a central position of the sheet thickness, and microstructure at the depth position typifies the steel structure of the hot-stamping formed body (shows the average microstructure of the entire hot-stamping formed body).

"Residual Austenite of which the Area Ratio is 5% or More and Less than 10%"

Residual austenite improves the collision characteristics of the hot-stamping formed body. In a case where the area ratio of residual austenite is less than 5%, desired uniform deformability cannot be obtained. For this reason, the area ratio of residual austenite is set to 5% or more. The area ratio of residual austenite is preferably 6% or more or 7% or more. On the other hand, in a case where the area ratio of residual austenite is 10% or more, desired strength cannot be obtained. For this reason, the area ratio of residual austenite is set to be less than 10%. The area ratio of residual austenite is preferably 9% or less or 8% or less.

"Bainite and Tempered Martensite of which the Total Area Ratio Exceeds 90% and is 95% or Less"

Bainite and tempered martensite improve the strength of the hot-stamping formed body. In a case where the total area ratio of bainite and tempered martensite is 90% or less, desired strength cannot be obtained. For this reason, the total area ratio of bainite and tempered martensite is set to exceed 90%. The total area ratio of bainite and tempered martensite is preferably 91% or more or 92% or more. On the other hand, in a case where the total area ratio of bainite and tempered martensite exceeds 95%, desired uniform deformability cannot be obtained. For this reason, the total area ratio of bainite and tempered martensite is set to 95% or less. The total area ratio of bainite and tempered martensite is preferably 94% or less or 93% or less.

"A Remainder in Microstructure of which the Area Ratio is Less than 5%"

Ferrite, pearlite, fresh martensite, and granular bainite may be included in the microstructure of the hot-stamping formed body according to this embodiment as the remainder in microstructure. In a case where the area ratio of the remainder in microstructure is high, desired strength and desired collision characteristics cannot be obtained. For this reason, the area ratio of the remainder in microstructure is set to be less than 5%. The area ratio of the remainder in microstructure is preferably 3% or less or 1% or less.

"Measurement of the Area Ratios of Residual Austenite and Bainite and Tempered Martensite"

A sample is cut out from an arbitrary position away from an end surface of the hot-stamping formed body by a distance of 50 mm or more (a position that avoids an end portion in a case where the sample cannot be collected at this position) so that a cross section (sheet thickness-cross section) perpendicular to the surface can be observed. The size of the sample also depends on a measurement device but is set to a size that can be observed by about 10 mm in a rolling direction.

After being polished using silicon carbide paper having a grit of #600 to #1500, the cross section of the sample is finished as a mirror surface using liquid in which diamond powder having a grain size in the range of 1 μm to 6 μm is dispersed in diluted solution of alcohol or the like or pure water. Then, the sample is polished for 8 minutes using colloidal silica not containing alkaline solution at a room temperature, so that strain introduced into the surface layer of the sample is removed. A region, which has a length of 50 μm and is present between a depth corresponding to ⅛ of the sheet thickness from the surface and a depth corresponding to ⅜ of the sheet thickness from the surface, is measured at a measurement interval of 0.1 μm at an arbitrary position on the cross section of the sample in a longitudinal direction by an electron backscatter diffraction method, so that crystal orientation information is obtained. An EBSD device formed of a schottky emission scanning electron microscope (JSM-7001F manufactured by JEOL Ltd.) and an EBSD detector (DVC5 detector manufactured by TSL Solutions) is used for measurement. In this case, the degree of vacuum in the EBSD device is set to $9.6\times10^{-5}$ Pa or less, an, accelerating voltage is set to 15 kV, an irradiation current level is set to 13, and the irradiation level of an electron beam is set to 62. The area ratio of residual austenite is calculated from the obtained crystal orientation information using "Phase Map" function of software "OIM Analysis (registered trademark)" included in an EBSD analysis device. A region where a crystal structure is fcc is determined as residual austenite.

Next, regions where a crystal structure is bcc are determined as bainite, tempered martensite, fresh martensite, granular bainite, and ferrite; regions where a grain average image quality value is less than 60000 in these regions are determined as bainite, tempered martensite, and fresh martensite using "Grain Average Misorientation" function of software "OIM Analysis (registered trademark)" included in the EBSD analysis device; and the sum of the area ratios of these regions is calculated, so that the total area ratio of "bainite, tempered martensite, and fresh martensite" is obtained. The area ratio of fresh martensite, which is obtained by a method to be described later, is subtracted from the total area ratio of "bainite, tempered martensite, and fresh martensite" obtained, by the above-mentioned method, so that the total area ratio of "bainite and tempered martensite" is obtained.

"Measurement of the Area Ratio of a Remainder in Microstructure"

A sample is cut out from an arbitrary position away from an end surface of the hot-stamping formed body by a distance of 50 mm or more (a position that avoids an end portion in a case where the sample cannot be collected at this position) so that a cross section (sheet thickness-cross section) perpendicular to the surface can be observed. The size of the sample also depends on a measurement device but is set to a size that can be observed by about 10 mm in a rolling direction.

After being polished using silicon carbide paper having a grit of #600 to #1500, the cross section of the sample is finished as a mirror surface using liquid in which diamond powder having a grain size in the range of 1 μm to 6 μm is dispersed in diluted solution of alcohol or the like or pure water and Nital etching is performed. Then, photographs having a plurality of visual fields are taken using a schottky emission scanning electron microscope (JSM-7001F manufactured by JEOL Ltd.) in a region that has a length of 50 μm and is present between a depth corresponding to ⅛ of the sheet thickness from the surface and a depth corresponding to ⅜ of the sheet thickness from the surface at an arbitrary position on the cross section of the sample in a longitudinal direction. Evenly spaced grids are drawn in the taken photographs, and structures at grid points are identified. The number of grid points corresponding to each structure is obtained and is divided by the total number of grid points, so that the area ratio of each structure is obtained. The area ratio can be more accurately obtained as the total number of grid points is larger. In this embodiment, grid spacings are set to 2 μm×2 μm and the total number of grid points is set to 1500.

A region where cementite is precipitated in a lamellar shape in the grains is determined as pearlite. A region where luminance is low and a substructure is not recognized is, determined as ferrite. Regions where luminance is high and a substructure does not appear after etching are determined as fresh martensite and residual austenite. Regions not corresponding to any of the above-mentioned region are determined as granular bainite. The area ratio of residual austenite obtained by the above-mentioned EBSD analysis is subtracted from the area ratio of fresh martensite and residual austenite obtained from the taken photographs, so that the area ratio of fresh martensite is obtained.

"A ratio of the length of a grain boundary (high angle boundary) having a rotation angle in the range of 55° to 75° to the total length of a grain boundary having a rotation angle in the range of 4° to 12°, a grain boundary having a rotation angle in the range of 49° to 54°, and a grain boundary having a rotation angle in the range of 55° to 75° among grain boundaries of crystal grains of bainite and tempered martensite to the <011> direction as a rotation axis is 30% or more."

A high angle boundary is a grain boundary that has the highest angle among grain boundaries included in the crystal grains of bainite and tempered martensite. A high angle boundary is highly effective in suppressing the propagation of cracks generated at the time of collision. In a case where a ratio of the length of a high angle boundary is less than 30%, desired collision characteristics cannot be obtained in the hot-stamping formed body. For this reason, a ratio of the length of a high angle boundary is set to 30% or more. A ratio of the length of a high angle boundary is preferably 35% or more, 40% or more, or 45% or more. The upper limit of a ratio of the length of a high angle boundary is not particularly specified. However, according to the chemical composition and a manufacturing method according to this embodiment, a substantial, upper limit thereof is 90%.

"Method of Measuring a Ratio of the Length of a High Angle Boundary"

A sample is cut out from a position away from an end surface of the hot-stamping formed body by a distance of 50 mm or more (a position that avoids an end portion in a case where the sample cannot be collected at this position) so that a cross section (sheet thickness-cross section) perpendicular to the surface can be observed. The sample also depends on a measurement device but is set to have a length that can be observed by about 10 mm in a rolling direction. A depth position of the cut-out sample corresponding to ¼ of a sheet thickness (a region between a depth corresponding to ⅛ of the sheet thickness from the surface and a depth corresponding to ⅜ of the sheet thickness from the surface) is subjected to EBSD analysis at a measurement interval of 0.1 μm. so that crystal orientation information is obtained. Here, the EBSD analysis is performed using an EBSD device formed of a schottky emission scanning electron microscope (JSM-7001F manufactured by JEOL Ltd.) and an EBSD detector (DVC5 detector manufactured by TSL Solutions) in a state where the irradiation level of an electron beam is 62.

Next, regions where a grain average image quality value is less than 60000 are determined as the crystal grains of bainite, tempered martensite, and fresh martensite with regard to the obtained crystal orientation information using "Grain Average Image Quality" function of software "OIM Analysis (registered trademark)" included in the EBSD analysis device; the length of a grain boundary having a rotation angle in the range of 4° to 12°, the length of a grain boundary having a rotation angle in the range of 49° to 54°, and the length of a grain boundary having a rotation angle in the range of 55° to 75° to the <011> direction as a rotation axis are calculated with regard to the grain boundaries of the crystal grains of bainite and tempered martensite among grain boundaries of these crystal grains; and a ratio of the length of a grain boundary having a rotation angle in the range of 55° to 75° to the value of the sum of the lengths of the respective grain boundaries is calculated. Accordingly, a ratio of the length of the grain boundary (high angle boundary) having a rotation angle in the range of 55° to 75° to the total length of the grain boundary having a rotation angle in the range of 4° to 12°, the grain boundary having a rotation angle in the range of 49° to 54° and the grain boundary (high angle boundary) having a rotation angle in the range of 55° to 75° among the crystal grains of bainite and tempered martensite to the <011> direction as a rotation axis is obtained.

Taken photographs may be obtained by the same method as a method of measuring the area ratio of the remainder in microstructure; fresh martensite may be determined from the crystal grains of bainite, tempered martensite, and fresh martensite; and fresh martensite may be excluded from the crystal grains of bainite, tempered martensite, and fresh martensite. The reason why the grain boundaries of the crystal grains of fresh martensite are not included in the measurement of a high angle boundary is that fresh martensite has high hardness and serves as the origin of fracture.

The length of the grain boundary can be easily calculated in a case where, for example, "Inverse Pole Figure Map" function and "Axis Angle" function of software "OIM Analysis (registered trademark)" included in the EBSD analysis device are used. In these functions, among grain boundaries of crystal grains of the bainite and the tempered martensite, the total length of the grain boundaries can be calculated in a case where specific rotation angles are specified to an arbitrary direction as a rotation axis. The above-mentioned analysis may be performed over all crystal grains included in a measurement region, and the lengths of the above-mentioned three types of grain boundaries among the grain boundaries of the crystal grains of bainite and tempered martensite to the <011> direction as a rotation axis may be calculated.

"Sheet Thickness and Tensile Strength"

The sheet thickness of the hot-stamping formed body according to this embodiment is not particularly limited. However, in terms of reducing the weight of a vehicle body, it is preferable that the sheet thickness of the hot-stamping formed body according to this embodiment is set in the range of 0.5 mm to 3.5 mm. Further, in terms of reducing the weight of a vehicle body, the tensile strength of the hot-stamping formed body is set to 1500 MPa or more. Preferably, the tensile strength of the hot-stamping formed body is set to 1800 MPa or more or 2000 MPa or more. The upper limit of the tensile strength is not particularly specified, but may be set to 2600 MPa or less or 2550 MPa or less.

"Plating Layer"

For the purpose of improving corrosion resistance and the like, a plating layer may be formed on the surface of the hot-stamping formed body according to this embodiment. The plating layer may be any of an electroplating layer and a hot-dip plating layer. The electroplating layer includes, for example, an electrogalvanized layer, an electrolytic Zn—Ni alloy plating layer, and the like. The hot-dip plating layer includes, for example, a hot-dip galvanized layer, a hot-dip galvannealed layer, a hot-dip aluminum plating layer, a hot-dip Zn—Al alloy plating layer, a hot-dip Zn—Al—Mg alloy plating layer, a hot-dip Zn—Al—Mg—Si alloy plating layer, and the like. The adhesion amount of a plating layer is not particularly limited and may be a general adhesion amount.

"Method of Manufacturing a Hot-Stamping Formed Body"

Next, a preferred method of manufacturing the hot-stamping formed body according to this embodiment will be described.

The hot-stamping formed body according to this embodiment can be manufactured by performing hot stamping on a cold-rolled steel sheet manufactured by a routine method or a cold-rolled steel sheet including a plating layer on the surface thereof, pressurizing and retaining the cold-rolled steel sheet in a predetermined temperature range after the hot stamping, and cooling the cold-rolled steel sheet.

"Heating and Holding Before Hot Stamping"

It is preferable that the cold-rolled steel sheet is held for 60 sec to 600 sec in the temperature range of 800° C. to 1000° C. before the hot stamping. In a case where a heating temperature is lower than 800° C. or a holding time is less than 60 sec, the cold-rolled steel sheet cannot be sufficiently austenitized. For this reason, a desired amount of bainite and tempered martensite may not be capable of being obtained in the hot-stamping formed body. In a case where a heating temperature exceeds 1000° C. or a holding time exceeds 600 sec, transformation into bainite and tempered martensite is delayed, due to an increase in austenite grain size. For this reason, a desired amount of bainite and tempered martensite may not be capable of being obtained.

An average heating rate during the heating may be set to 0.1° C./s or more or 200° C./s or less. An average heating rate mentioned here is a value that is obtained in a case where a temperature difference between the surface temperature of a steel sheet at the time of start of the heating and a holding temperature is divided by a time difference from the start of the heating to a time when a temperature reaches a holding temperature. Further, during the holding, the temperature of a steel sheet may be fluctuated in the temperature range of 800° C. to 1000° C. or may be constant.

Examples of a heating method before the hot stamping include heating using an electric furnace, a gas furnace, or the like, flame heating, energization heating, high-frequency heating, induction heating, and the like.

"Cooling after Hot Stamping"

Hot stamping is performed after the heating and the holding described above. After the hot stamping, it is preferable that cooling is performed at an average cooling rate of 1.0° C./s to 100° C./s up to the temperature range of 200° C. to 400° C. In a case where a cooling stop temperature is lower than 200° C. in the cooling after the hot stamping, the stabilization of residual austenite is not facilitated. For this reason, a desired amount of residual austenite may not be capable of being obtained. In a case where a cooling stop temperature exceeds 400° C., the hardness of prior austenite grains is reduced. For this reason, a desired number of high angle boundaries may not be capable of being formed. Further, in a case where, an average cooling rate is lower than 1.0° C./s, transformation into ferrite, granular bainite, or pearlite is facilitated. For this reason, a desired amount of bainite and tempered martensite may not, be capable of being obtained. In a case where an average cooling rate exceeds 100° C./s, the driving force of transformation into tempered martensite and bainite is increased and an action for relieving strain to be introduced by transformation is reduced. For this reason, it is difficult to obtain a desired number of high angle boundaries.

An average cooling rate mentioned here is a value of the difference in the surface temperatures between at the cooling start and at the cooling end divided by time difference between the cooling start and the cooling end.

"Pressurization and Holding"

Pressurization and holding are performed for a holding, time of 30 sec to 3600 sec at a contact pressure P (MPa), which satisfies Expression (1), in the temperature range of 200° C. to 400° C.

In a case where a holding time is less than 30 sec, carbon is not sufficiently distributed to untransformed austenite from martensite. For this reason, a desired amount of residual austenite may not be capable of being obtained. In a case, where a holding time exceeds 3600 sec, the softening of bainite or tempered martensite proceeds. For this reason, a desired strength may not be capable of being obtained. In a case where a contact pressure P is less than the left side of the following expression (1), the deformation of prior austenite grains is not sufficiently suppressed. For this reason, the ratio of a high angle boundary may be reduced.

The upper limit of a contact pressure P is not particularly limited. However, in order to prevent equipment from being broken, a substantial upper limit thereof is 300 MPa with regard to a material having the strength class of this embodiment. During the pressurization and holding, the temperature of a steel sheet may be fluctuated in the temperature range of 200° C. to 400° C. or may be constant.

Pressurization and holding may be performed after a formed steel sheet is transported to a separate die, which has a heating function, from a die that has been subjected to hot stamping and cooling after the hot stamping.

In a case where the steel sheet is heated in, the temperature range of 400° C. or more after hot stamping and cooling and before being pressurized and held, bainite is generated. As a result, a desired number of high angle boundaries cannot be obtained. For this reason, in a case where the hot-stamping formed body according to this embodiment is to be, manufactured, it is not preferable that, the steel sheet is heated in the temperature range of 400° C. or more after hot stamping and cooling and before being pressurized and held.

$$-1.85\times Ms+755\leq P\leq 300 \quad \text{Expression (1)}$$

$$Ms(^\circ C.)=539-423\times C-30\times Mn-12\times Cr-17\times Ni-7.5\times Mo \quad \text{Expression (2)}$$

A symbol, of an element in Expression (2) represents the content of each element by mass %, and is substituted for 0 in a case where the element is not contained.

"Cooling after Pressurization and Holding"

It is preferable that the steel sheet is cooled up to a temperature of 80° C. or less at an average cooling rate of 1.0° C./s to 100° C./s after the pressurization and holding. In a case where an average cooling rate is lower than 1.0° C./s, residual austenite may be decomposed. In a case where an average cooling rate exceeds 100° C./s, a load is applied to the device. Residual austenite is decomposed. An average cooling rare mentioned here is a value of the difference in the surface temperatures between at the time of start of the cooling after the pressurization and holding and at the time of end of the cooling divided by time difference between the cooling start and the cooling end.

EXAMPLES

Next, examples of the present invention will be described. Conditions in the examples are one condition example that is employed to confirm the feasibility and effects of the present invention, and the present invention is not limited to this condition example. The present invention may employ various conditions to achieve the object of the present invention without departing from the scope of the present invention.

Hot rolling and cold rolling were performed on steel pieces manufactured by the casting of molten steel having the chemical composition shown in Tables 1 and 2, and plating was performed on the steel pieces as necessary, so that cold-rolled steel sheets were obtained. Then, hot-stamping formed, bodies shown in Tables 3 and 4 were manufactured using the cold-rolled steel sheets under conditions shown in Tables 3 and 4.

An average heating rate during heating before hot stamping was set to 0.1° C./s to 200° C./s, cooling after hot stamping was performed up to the temperature range of 200° C. to 400° C., and cooling after pressurization and holding was performed up to a temperature of 80° C. or less.

Further, Manufacture No. 16 of Table 3 was provided with a hot-dip aluminum plating layer and Manufacture No. 17 was provided with a hot-dip galvanized layer.

Manufacture No. 55 was held for 30 sec in the temperature range of 410° C. to 560° C. after hot stamping and cooling and before pressurization and holding, and was then subjected to pressurization and holding shown in Table 4.

An underline in Tables represents that a condition is out of the range of the present invention, a condition is out of a preferred manufacturing condition, or a characteristic value is not preferred. γr in Tables 3 and 4 denotes residual austenite, B denotes bainite, and TM denotes tempered martensite.

With regard to the microstructure of the hot-stamping formed body, the measurement of the area ratio of each structure and the measurement of a ratio of the length of a high angle boundary were performed by the above-mentioned measurement methods. Further, the mechanical characteristics of the hot-stamping formed body were evaluated by the following methods.

"Tensile Strength"

No. 5 test pieces described in JIS Z 2241:2011 were prepared from an arbitrary position of the hot-stamping formed body, and the tensile strength of the hot-stamping formed body was obtained according to a test method described in JIS Z 2241:2011. The speed of across-head was set to 3 mm/min. The test piece was determined to be acceptable in a case where tensile strength was 1500 MPa or more, and was determined to be unacceptable in a case where tensile strength was less than 1500 MPa.

"Collision Characteristics (Uniform Deformability and Crack Propagation Suppression Effect)"

The collision characteristics of the hot-stamping formed body were evaluated by the following method on the basis of VDA standards (VDA238-100) specified by the German Association of the Automotive Industry.

In this example, absorbed energy S1 was obtained as the index of uniform deformability and absorbed energy S2 was obtained as the index of a crack propagation suppression effect from an F-S curve (load-bending angle diagram) shown in FIG. 1 that was obtained from a bending test. An increase in load per unit bending angle until a load reaches the maximum load from the start of a test was calculated according to the gradient of the F-S curve and S1 was calculated as an integrated value (absorbed energy S1) of these minute areas. A change in load per unit bending angle until a load is reduced to ½ of the maximum load after a load reaches the maximum load was calculated according to the gradient of the F-S curve and S2 was calculated as an integrated value (absorbed energy S2) of these minute areas.

In this example, the test piece was determined to be acceptable since being excellent in uniform deformability in a case where S1 was 100 (°·kN) or more; and was written as "Fair" in a case where S1 was 100 (°·kN) or more, was written as "Good" in a case where S1 was 120 (°·kN) or more, and was written as "Very Good" in a case where S1 was 180 (°·kN) or more in Tables 3 and 4. In a case where S1 was less than 100 (°·kN), the hot-stamping formed body was determined, to be unacceptable since being inferior in uniform deformability and was written as "Bad" in Tables 3 and 4.

The test piece was determined to be acceptable since being excellent in crack propagation suppression characteristics in a case where a value (S2/(S1+S2)), which is obtained in a case where S2 is divided by the sum of S1 and S2, is 0.01 or more; and was written as "Fair" in a case where the value (S2/(S1+S2)) was 0.01 or more, was written, as "Good" in a case where the value (S2/(S1+S2)) was 0.02 or more, and was written as "Very Good" in a case where the value (S2/(S1+S2)) was 0.07 or more in Tables 3 and 4. In a case where the value (S2/(S1+S2)) was less than 0.01, the test piece was determined to be unacceptable since being inferior in crack propagation characteristics and was written as "Bad" in Tables 3 and 4.

The conditions of the bending test were as follows.

Dimensions of test piece: 60 mm (rolling direction)×30 mm (a direction parallel to a sheet width direction)

Sheet thickness of test piece: 1.01 to 1.05 mm (the surface and back were ground by the same amount)

Bending ridge: a direction parallel to a sheet width direction

Test method: roll support and punch pressing

Roll, diameter: φ 30 mm

Punch shape: tip end R=0.4 mm

Roll-to-roll distance: 2.0×sheet thickness (min)+0.5 mm

Pressing speed: 20 mm/mm

Testing machine: AG-100KNI manufactured by Shimadzu Corporation

It is found from Tables 3 and 4 that a hot-stamping formed body of which the chemical composition and the microstructure are in the range of the present invention has excellent strength and collision characteristics.

On the other hand, it is found that a hot-stamping formed body of which any one or more of the chemical composition and the microstructure is out of the present invention is inferior in one or more of strength and collision characteristics.

TABLE 1

| Steel | Chemical composition (mass %) Remainder Fe and impurities | | | | | | | | Ms | |
|---|---|---|---|---|---|---|---|---|---|---|
| No. | C | Si | Mn | Al | P | S | N | Others | (° C.) | Note |
| 1 | 0.30 | 1.72 | 1.94 | 0.441 | 0.004 | 0.0018 | 0.0041 | | 354 | Steel of invention |
| 2 | 0.46 | 0.97 | 0.85 | 0.311 | 0.006 | 0.0004 | 0.0047 | | 319 | Steel of invention |
| 3 | 0.32 | 0.61 | 1.90 | 0.309 | 0.003 | 0.0019 | 0.0028 | | 347 | Steel of invention |
| 4 | 0.37 | 2.88 | 1.87 | 0.533 | 0.005 | 0.0026 | 0.0049 | | 326 | Steel of invention |
| 5 | 0.35 | 1.82 | 0.78 | 0.365 | 0.010 | 0.0018 | 0.0030 | | 368 | Steel of invention |
| 6 | 0.34 | 0.94 | 2.91 | 0.504 | 0.006 | 0.0020 | 0.0035 | | 308 | Steel of invention |
| 7 | 0.32 | 0.99 | 1.69 | 0.001 | 0.002 | 0.0026 | 0.0047 | | 353 | Steel of invention |
| 8 | 0.37 | 1.78 | 0.97 | 1.880 | 0.007 | 0.0004 | 0.0038 | | 353 | Steel of invention |

TABLE 1-continued

| Steel | Chemical composition (mass %) Remainder Fe and impurities | | | | | | | | Ms | |
|---|---|---|---|---|---|---|---|---|---|---|
| No. | C | Si | Mn | Al | P | S | N | Others | (° C.) | Note |
| 9 | 0.34 | 1.64 | 1.49 | 0.740 | 0.081 | 0.0019 | 0.0025 | | 350 | Steel of invention |
| 10 | 0.34 | 1.62 | 1.80 | 0.668 | 0.0001 | 0.0012 | 0.0044 | | 341 | Steel of invention |
| 11 | 0.35 | 1.17 | 1.05 | 0.799 | 0.005 | 0.0780 | 0.0027 | | 359 | Steel of invention |
| 12 | 0.31 | 1.04 | 1.41 | 0.618 | 0.004 | 0.0003 | 0.0048 | | 366 | Steel of invention |
| 13 | 0.37 | 1.55 | 1.35 | 0.478 | 0.009 | 0.0013 | 0.0071 | | 342 | Steel of invention |
| 14 | 0.37 | 1.18 | 0.90 | 0.423 | 0.002 | 0.0030 | 0.0002 | | 355 | Steel of invention |
| 15 | 0.35 | 1.69 | 1.35 | 0.459 | 0.003 | 0.0022 | 0.0029 | | 350 | Steel of invention |
| 16 | 0.36 | 1.45 | 1.29 | 0.432 | 0.003 | 0.0022 | 0.0029 | Nb: 0.032, Ti: 0.002, Cr: 0.20, B: 0.0020, Mo: 0.10 | 345 | Steel of invention |
| 17 | 0.46 | 1.50 | 1.27 | 0.443 | 0.003 | 0.0022 | 0.0029 | Nb: 0.028, Ti: 0.002, Cr: 0.20, B: 0.0022, Mo: 0.10 | 303 | Steel of invention |
| 18 | 0.32 | 1.74 | 1.68 | 0.498 | 0.007 | 0.0029 | 0.0042 | Co: 0.23 | 353 | Steel of invention |
| 19 | 0.32 | 1.14 | 1.26 | 0.783 | 0.003 | 0.0011 | 0.0028 | Nb: 0.045 | 366 | Steel of invention |
| 20 | 0.30 | 1.00 | 1.15 | 0.398 | 0.008 | 0.0015 | 0.0049 | Ti: 0.018 | 378 | Steel of invention |
| 21 | 0.34 | 1.51 | 1.94 | 0.659 | 0.010 | 0.0015 | 0.0029 | Mo: 0.10 | 336 | Steel of invention |
| 22 | 0.35 | 1.72 | 1.75 | 0.751 | 0.010 | 0.0019 | 0.0042 | Cr: 0.21 | 336 | Steel of invention |

TABLE 2

| Steel | Chemical composition (mass %) Remainder Fe and impurities | | | | | | | | Ms | |
|---|---|---|---|---|---|---|---|---|---|---|
| No. | C | Si | Mn | Al | P | S | N | Others | (° C.) | Note |
| 23 | 0.34 | 1.52 | 1.85 | 0.329 | 0.004 | 0.0011 | 0.0031 | Cu: 0.25 | 340 | Steel of invention |
| 24 | 0.32 | 1.57 | 1.14 | 0.414 | 0.004 | 0.0023 | 0.0026 | V: 0.28 | 369 | Steel of invention |
| 25 | 0.35 | 1.42 | 1.13 | 0.348 | 0.009 | 0.0027 | 0.0025 | W: 0.26 | 357 | Steel of invention |
| 26 | 0.30 | 1.37 | 0.85 | 0.450 | 0.008 | 0.0026 | 0.0033 | Ni: 0.31 | 381 | Steel of invention |
| 27 | 0.35 | 1.61 | 1.34 | 0.372 | 0.010 | 0.0022 | 0.0049 | Mg: 0.02 | 351 | Steel of invention |
| 28 | 0.33 | 1.66 | 1.61 | 0.558 | 0.003 | 0.0016 | 0.0042 | Zr: 0.03 | 351 | Steel of invention |
| 29 | 0.37 | 1.41 | 1.84 | 0.498 | 0.009 | 0.0025 | 0.0029 | Sb: 0.02 | 327 | Steel of invention |
| 30 | 0.37 | 1.39 | 1.84 | 0.411 | 0.007 | 0.0027 | 0.0029 | B: 0.0020 | 327 | Steel of invention |
| 31 | 0.33 | 1.19 | 1.68 | 0.418 | 0.007 | 0.0014 | 0.0030 | Ca: 0.02 | 349 | Steel of invention |
| 32 | 0.31 | 1.41 | 1.02 | 0.545 | 0.010 | 0.0015 | 0.0043 | REM: 0.12 | 377 | Steel of invention |
| 33 | 0.25 | 1.09 | 1.92 | 0.773 | 0.006 | 0.0022 | 0.0041 | | 376 | Comparative steel |
| 34 | 0.59 | 1.50 | 0.60 | 0.491 | 0.004 | 0.0006 | 0.0027 | | 271 | Comparative steel |
| 35 | 0.33 | 0.21 | 1.55 | 0.731 | 0.009 | 0.0025 | 0.0040 | | 353 | Comparative steel |
| 36 | 0.33 | 3.26 | 1.09 | 0.593 | 0.008 | 0.0006 | 0.0043 | | 367 | Comparative steel |
| 37 | 0.37 | 1.10 | 0.32 | 0.307 | 0.004 | 0.0007 | 0.0045 | | 373 | Comparative steel |
| 38 | 0.34 | 1.55 | 3.24 | 0.409 | 0.004 | 0.0018 | 0.0041 | | 298 | Comparative steel |
| 39 | 0.37 | 1.17 | 1.08 | 0.0001 | 0.009 | 0.0018 | 0.0044 | | 350 | Comparative steel |
| 40 | 0.33 | 1.03 | 1.24 | 2.110 | 0.005 | 0.0019 | 0.0045 | | 362 | Comparative steel |
| 41 | 0.37 | 1.30 | 1.19 | 0.319 | 0.210 | 0.0009 | 0.0049 | | 347 | Comparative steel |
| 42 | 0.32 | 1.08 | 1.33 | 0.457 | 0.007 | 0.1800 | 0.0028 | | 364 | Comparative steel |
| 43 | 0.36 | 1.79 | 1.00 | 0.603 | 0.006 | 0.0024 | 0.0210 | | 357 | Comparative steel |

An underline represents that a condition is out of the range of the present invention.

TABLE 3

| | | Heating | | Cooling after HS Average cooling rate until pressurization and holding | Pressurization and holding | | | | Cooling after pressurization and holding |
|---|---|---|---|---|---|---|---|---|---|
| Manufacture No. | Steel No. | Heating temperature (° C.) | Holding time (s) | (° C./s) | Holding temperature (° C.) | Holding time (s) | Left side of Expression (1) | Contact pressure P (MPa) | Average cooling rate (° C./s) |
| 1 | 1 | 910 | 311 | 22 | 303 | 93 | 100 | 122 | 44 |
| 2 | 2 | 889 | 293 | 23 | 287 | 246 | 165 | 180 | 40 |
| 3 | 3 | 888 | 333 | 10 | 309 | 359 | 114 | 143 | 58 |
| 4 | 4 | 885 | 307 | 8 | 330 | 226 | 151 | 179 | 57 |
| 5 | 5 | 883 | 333 | 6 | 337 | 76 | 75 | 93 | 30 |
| 6 | 6 | 902 | 327 | 5 | 311 | 280 | 185 | 202 | 56 |
| 7 | 7 | 891 | 342 | 16 | 322 | 307 | 102 | 128 | 36 |

TABLE 3-continued

| | | | | | | | | | |
|---|---|---|---|---|---|---|---|---|---|
| 8 | 8 | 896 | 351 | 23 | 299 | 226 | 101 | 119 | 51 |
| 9 | 9 | 917 | 322 | 20 | 344 | 304 | 107 | 127 | 56 |
| 10 | 10 | 880 | 285 | 27 | 310 | 325 | 124 | 152 | 22 |
| 11 | 11 | 880 | 268 | 23 | 346 | 211 | 90 | 117 | 49 |
| 12 | 12 | 899 | 342 | 8 | 287 | 140 | 79 | 100 | 35 |
| 13 | 13 | 915 | 273 | 24 | 306 | 197 | 122 | 152 | 55 |
| 14 | 14 | 912 | 307 | 11 | 321 | 163 | 97 | 109 | 60 |
| 15 | 15 | 914 | 328 | 25 | 290 | 274 | 107 | 132 | 54 |
| 16 | 16 | 881 | 259 | 27 | 311 | 310 | 117 | 142 | 50 |
| 17 | 17 | 892 | 243 | 29 | 319 | 348 | 194 | 213 | 57 |
| 18 | 18 | 889 | 282 | 23 | 321 | 87 | 102 | 121 | 37 |
| 19 | 19 | 897 | 293 | 26 | 314 | 46 | 78 | 106 | 60 |
| 20 | 20 | 899 | 272 | 6 | 340 | 189 | 56 | 69 | 28 |
| 21 | 21 | 900 | 284 | 13 | 303 | 303 | 133 | 163 | 26 |
| 22 | 22 | 906 | 330 | 17 | 285 | 201 | 134 | 150 | 39 |
| 23 | 23 | 889 | 323 | 30 | 285 | 223 | 127 | 145 | 36 |
| 24 | 24 | 914 | 279 | 7 | 312 | 167 | 72 | 98 | 43 |
| 25 | 25 | 896 | 285 | 10 | 335 | 348 | 94 | 123 | 23 |
| 26 | 26 | 884 | 359 | 20 | 324 | 268 | 50 | 67 | 35 |
| 27 | 27 | 893 | 269 | 29 | 289 | 139 | 106 | 124 | 50 |
| 28 | 28 | 893 | 328 | 25 | 329 | 300 | 105 | 119 | 32 |
| 29 | 29 | 894 | 328 | 19 | 314 | 254 | 150 | 172 | 36 |
| 30 | 30 | 909 | 336 | 29 | 294 | 332 | 150 | 160 | 28 |
| 31 | 31 | 884 | 355 | 16 | 318 | 164 | 109 | 123 | 47 |
| 32 | 32 | 912 | 351 | 16 | 321 | 168 | 57 | 62 | 32 |

| | Microstructure | | | | Mechanical characteristics | | | |
|---|---|---|---|---|---|---|---|---|
| Manufacture No. | γr (area %) | B + TM (area %) | Remainder (area %) | Ratio of length of grain boundary having rotation angle in range of 55° to 75° (%) | Tensile strength (MPa) | S1 | S2/(S1 + S2) | Note |
| 1 | 6 | 92 | 2 | 35 | 1590 | Fair | Good | Example of invention |
| 2 | 7 | 91 | 2 | 44 | 2510 | Fair | Good | Example of invention |
| 3 | 6 | 92 | 2 | 39 | 1912 | Fair | Good | Example of invention |
| 4 | 5 | 91 | 4 | 46 | 1856 | Good | Fair | Example of invention |
| 5 | 5 | 91 | 4 | 48 | 1857 | Good | Fair | Example of invention |
| 6 | 8 | 91 | 1 | 49 | 1899 | Fair | Good | Example of invention |
| 7 | 6 | 91 | 3 | 52 | 1933 | Good | Fair | Example of invention |
| 8 | 7 | 91 | 2 | 47 | 2039 | Good | Fair | Example of invention |
| 9 | 6 | 91 | 3 | 39 | 1962 | Good | Fair | Example of invention |
| 10 | 6 | 91 | 3 | 40 | 1893 | Good | Very Good | Example of invention |
| 11 | 7 | 91 | 2 | 41 | 2037 | Good | Fair | Example of invention |
| 12 | 6 | 91 | 3 | 43 | 1902 | Good | Very Good | Example of invention |
| 13 | 6 | 91 | 3 | 49 | 1858 | Good | Fair | Example of invention |
| 14 | 8 | 91 | 1 | 50 | 2063 | Good | Very Good | Example of invention |
| 15 | 6 | 91 | 3 | 43 | 2083 | Very Good | Very Good | Example of invention |
| 16 | 6 | 91 | 3 | 44 | 2017 | Very Good | Very Good | Example of invention |
| 17 | 7 | 92 | 1 | 50 | 2025 | Very Good | Very Good | Example of invention |
| 18 | 8 | 91 | 1 | 72 | 1839 | Good | Very Good | Example of invention |
| 19 | 7 | 92 | 1 | 67 | 2042 | Good | Very Good | Example of invention |
| 20 | 8 | 91 | 1 | 62 | 2013 | Good | Very Good | Example of invention |
| 21 | 7 | 92 | 1 | 68 | 1963 | Good | Very Good | Example of invention |
| 22 | 7 | 92 | 1 | 64 | 1925 | Good | Very Good | Example of invention |

TABLE 3-continued

| | | | | | | | | |
|---|---|---|---|---|---|---|---|---|
| 23 | 7 | 92 | 1 | 63 | 1987 | Good | Very Good | Example of invention |
| 24 | 7 | 92 | 1 | 67 | 1815 | Good | Very Good | Example of invention |
| 25 | 6 | 91 | 3 | 65 | 1819 | Good | Very Good | Example of invention |
| 26 | 6 | 91 | 3 | 65 | 1820 | Good | Very Good | Example of invention |
| 27 | 7 | 92 | 1 | 42 | 1960 | Good | Very Good | Example of invention |
| 28 | 6 | 91 | 3 | 37 | 2032 | Good | Very Good | Example of invention |
| 29 | 6 | 91 | 3 | 45 | 2089 | Good | Very Good | Example of invention |
| 30 | 6 | 91 | 3 | 49 | 1842 | Good | Very Good | Example of invention |
| 31 | 7 | 92 | 1 | 44 | 1812 | Good | Very Good | Example of invention |
| 32 | 7 | 91 | 2 | 45 | 1831 | Good | Very Good | Example of invention |

TABLE 4

| | | Heating | | Cooling after HS Average cooling rate until | Pressurization and holding | | | | Cooling after pressurization and holding |
|---|---|---|---|---|---|---|---|---|---|
| Manufacture No. | Steel No. | Heating temperature (° C.) | Holding time (s) | pressurization and holding (° C./s) | Holding temperature (° C.) | Holding time (s) | Left side of Expression (1) | Contact pressure P (MPa) | Average cooling rate (° C./s) |
| 33 | 33 | 882 | 345 | 20 | 295 | 103 | 60 | 71 | 52 |
| 34 | 34 | 890 | 271 | 7 | 326 | 211 | 253 | 285 | 31 |
| 35 | 35 | 901 | 327 | 7 | 347 | 360 | 102 | 119 | 34 |
| 36 | 36 | 904 | 284 | 5 | 332 | 194 | 77 | 105 | 43 |
| 37 | 37 | 896 | 338 | 16 | 291 | 153 | 65 | 80 | 51 |
| 38 | 38 | 886 | 266 | 17 | 345 | 246 | 204 | 223 | 60 |
| 39 | 39 | 905 | 296 | 5 | 283 | 341 | 107 | 130 | 43 |
| 40 | 40 | 909 | 300 | 20 | 320 | 84 | 85 | 111 | 47 |
| 41 | 41 | 901 | 333 | 26 | 348 | 303 | 113 | 139 | 35 |
| 42 | 42 | 911 | 340 | 15 | 323 | 289 | 82 | 92 | 23 |
| 43 | 43 | 897 | 245 | 8 | 323 | 218 | 95 | 119 | 27 |
| 44 | 15 | 750 | 304 | 5 | 314 | 186 | 107 | 129 | 51 |
| 45 | 15 | 1089 | 266 | 20 | 336 | 86 | 107 | 128 | 25 |
| 16 | 15 | 908 | 48 | 27 | 281 | 307 | 107 | 124 | 44 |
| 47 | 15 | 918 | 647 | 18 | 324 | 46 | 107 | 119 | 29 |
| 48 | 15 | 882 | 247 | 0.2 | 292 | 93 | 107 | 134 | 37 |
| 49 | 15 | 883 | 349 | 26 | 154 | 337 | 107 | 127 | 57 |
| 50 | 15 | 903 | 356 | 19 | 409 | 208 | 107 | 127 | 46 |
| 51 | 15 | 880 | 303 | 28 | 348 | 21 | 107 | 133 | 52 |
| 52 | 15 | 885 | 318 | 30 | 344 | 3895 | 107 | 117 | 29 |
| 53 | 15 | 908 | 360 | 22 | 288 | 221 | 107 | 87 | 53 |
| 54 | 15 | 918 | 276 | 26 | 306 | 298 | 107 | 121 | 0.6 |
| 55* | 15 | 906 | 300 | 14 | 340 | 264 | 107 | 135 | 47 |

| | Microstructure | | | | Mechanical characteristics | | | |
|---|---|---|---|---|---|---|---|---|
| Manufacture No. | γr (area %) | B + TM (area %) | Remainder (area %) | Ratio of length of grain boundary having rotation angle in range of 55° to 75° (%) | Tensile strength (MPa) | S1 | S2/(S1 + S2) | Note |
| 33 | 6 | 91 | 3 | 49 | 1204 | Good | Good | Comparative Example |
| 34 | 7 | 91 | 2 | 46 | 2503 | Bad | Good | Comparative Example |
| 35 | 2 | 94 | 4 | 39 | 1863 | Bad | Good | Comparative Example |
| 36 | 7 | 86 | 7 | 46 | 1992 | Good | Bad | Comparative Example |
| 37 | 7 | 85 | 8 | 53 | 1920 | Good | Bad | Comparative Example |

TABLE 4-continued

| | | | | | | | | |
|---|---|---|---|---|---|---|---|---|
| 38 | 6 | 91 | 3 | 54 | 1889 | Bad | Good | Comparative Example |
| 39 | 7 | 91 | 2 | 54 | 2063 | Good | Bad | Comparative Example |
| 40 | 7 | 92 | 1 | 48 | 2044 | Good | Bad | Comparative Example |
| 41 | 7 | 92 | 1 | 37 | 1950 | Good | Bad | Comparative Example |
| 42 | 7 | 92 | 1 | 41 | 1820 | Good | Bad | Comparative Example |
| 43 | 7 | 90 | 3 | 41 | 1865 | Good | Bad | Comparative Example |
| 44 | 7 | 57 | 36 | 42 | 1321 | Good | Bad | Comparative Example |
| 45 | 8 | 50 | 42 | 47 | 1410 | Good | Bad | Comparative Example |
| 16 | 8 | 51 | 41 | 53 | 1258 | Good | Bad | Comparative Example |
| 47 | 8 | 56 | 36 | 38 | 1362 | Good | Bad | Comparative Example |
| 48 | 7 | 85 | 8 | 43 | 1995 | Good | Bad | Comparative Example |
| 49 | 4 | 94 | 2 | 38 | 1941 | Bad | Good | Comparative Example |
| 50 | 7 | 92 | 1 | 21 | 2042 | Good | Bad | Comparative Example |
| 51 | 1 | 97 | 2 | 54 | 1951 | Bad | Good | Comparative Example |
| 52 | 7 | 91 | 2 | 45 | 1164 | Good | Good | Comparative Example |
| 53 | 6 | 91 | 3 | 19 | 2069 | Good | Bad | Comparative Example |
| 54 | 1 | 96 | 3 | 43 | 1803 | Bad | Good | Comparative Example |
| 55* | 7 | 92 | 1 | 22 | 1886 | Good | Bad | Comparative Example |

An underline represents that a condition is out of the range of the present invention, a manufacturing condition is not preferred, or characteristicsare not preferred.
*heating and holding before pressurization and holding

INDUSTRIAL APPLICABILITY

According to the aspect of the present invention, it is possible, to obtain a hot-stamping formed body that is excellent in strength and collision characteristics.

The invention claimed is:

1. A hot-stamping formed body comprising, as a chemical composition, by mass %:

C: 0.30% to 0.50%;
Si: 0.50% to 3.00%;
Mn: 0.50% to 3.00%;
Al: 0.0002% to 2.000%;
P: 0.100% or less;
S: 0.1000% or less;
N: 0.0100% or less;
Nb: 0% to 0.150%;
Ti: 0% to 0.150%;
Co: 0% to 2.00%;
Mo: 0% to 1.00%;
Cr: 0% to 1.00%;
Cu: 0% to 1.00%;
V: 0% to 1.00%;
W: 0% to 1.00%;
Ni: 0% to 3.00%;
Mg: 0% to 1.00%;
Zr: 0% to 1.00%;
Sb: 0% to 1.00%;
Ca: 0% to 0.10%;
REM: 0% to 0.30%;
B: 0% to 0.0100%; and
a remainder consisting of Fe and impurities; and microstructure which includes residual austenite of which an area ratio is 5% or more and less than 10%, bainite and tempered martensite of which a total area ratio exceeds 90% and is 95% or less, and a remainder in microstructure of which an area ratio is less than 5%, among grain boundaries of crystal grains of the bainite and the tempered martensite, a ratio of a length of a grain boundary having a rotation angle in a range of 55° to 75° to a total length of a grain boundary having a rotation angle in a range of 4° to 12°, a grain boundary having a rotation angle in a range of 49° to 54°, and the grain boundary having a rotation angle in a range of 55° to 75° to the <011> direction as a rotation axis is 30% or more, wherein a tensile strength of the hot-stamping formed body is 1500 MPa or more.

2. The hot-stamping formed body according to claim 1, further comprising, as the chemical composition, by mass %, at least one selected from the group of:

Nb: 0.010% to 0.150%;
Ti: 0.010% to 0.150%;
Co: 0.01% to 2.00%;
Mo: 0.005% to 1.00%;
Cr: 0.005% to 1.00%;
Cu: 0.001% to 1.00%;
V: 0.0005% to 1.00%;
W: 0.001% to 1.00%;
Ni: 0.001% to 3.00%;
Mg: 0.001% to 1.00%;
Zr: 0.001% to 1.00%;
Sb: 0.001% to 1.00%;
Ca: 0.001% to 0.10%;
REM: 0.001% to 0.30%; and
B: 0.0005% to 0.0100%.

3. A hot-stamping formed body comprising, as a chemical composition, by mass %:

C: 0.30% to 0.50%;
Si: 0.50% to 3.00%;
Mn: 0.50% to 3.00%;
Al: 0.0002% to 2.000%;
P: 0.100% or less;
S: 0.1000% or less;
N: 0.0100% or less;
Nb: 0% to 0.150%;
Ti: 0% to 0.150%;
Co: 0% to 2.00%;
Mo: 0% to 1.00%;
Cr: 0% to 1.00%;
Cu: 0% to 1.00%;
V: 0% to 1.00%;
W: 0% to 1.00%;
Ni: 0% to 3.00%;
Mg: 0% to 1.00%;
Zr: 0% to 1.00%;
Sb: 0% to 1.00%;
Ca: 0% to 0.10%;
REM: 0% to 0.30%;
B: 0% to 0.0100%; and
a remainder comprising Fe and impurities; and microstructure which includes residual austenite of which an area ratio is 5% or more and less than 10%, bainite and tempered martensite of which a total area ratio exceeds 90% and is 95% or less, and a remainder in microstructure of which an area ratio is less than 5%, among grain boundaries of crystal grains of the bainite and the tempered martensite, a ratio of a length of a grain boundary having a rotation angle in a range of 55° to 75° to a total length of a grain boundary having a rotation angle in a range of 4° to 12°, a grain boundary having a rotation angle in a range of 49° to 54°, and the grain boundary having a rotation angle in a range of 55° to 75° to the <011> direction as a rotation axis is 30% or more, wherein a tensile strength of the hot-stamping formed body is 1500 MPa or more.

* * * * *